US008075219B2

(12) United States Patent
Greville

(10) Patent No.: US 8,075,219 B2
(45) Date of Patent: Dec. 13, 2011

(54) GRATES

(76) Inventor: Paul Lawrence Greville, Palmerston (AU)

( * ) Notice: Subject to any disclaimer, the term of this patent is extended or adjusted under 35 U.S.C. 154(b) by 0 days.

(21) Appl. No.: 12/485,332

(22) Filed: Jun. 16, 2009

(65) Prior Publication Data

US 2009/0311043 A1 Dec. 17, 2009

(30) Foreign Application Priority Data

Jun. 16, 2008 (AU) ..... 2008903025
Mar. 26, 2009 (AU) ..... 2009201190

(51) Int. Cl.
*E01C 11/22* (2006.01)

(52) U.S. Cl. ..... 404/2; 404/4

(58) Field of Classification Search ..... 404/2, 4, 404/7, 34–36
See application file for complete search history.

(56) References Cited

U.S. PATENT DOCUMENTS 1,310,331 A * 7/1919 Ficklen ..... 404/8
1,977,021 A * 10/1934 Spencer ..... 47/33
2,286,204 A * 6/1942 Greulich ..... 52/663
2,390,194 A * 12/1945 Tarof ..... 52/181
4,125,964 A * 11/1978 Waggoner ..... 47/33
4,452,025 A 6/1984 Lew
5,024,550 A 6/1991 Mainville
5,037,688 A * 8/1991 Uchida ..... 428/102
5,040,928 A * 8/1991 Vidal ..... 405/284
5,421,118 A * 6/1995 Bauer ..... 47/33
5,604,949 A 2/1997 Mangone
5,735,008 A 4/1998 Mangone
5,993,107 A * 11/1999 Bauer ..... 404/43

FOREIGN PATENT DOCUMENTS

JP 11-210065 8/1999

* cited by examiner

*Primary Examiner* — Raymond Addie
(74) *Attorney, Agent, or Firm* — Nixon & Vanderhye P.C.

(57) ABSTRACT

An improved grate 601 is made from a plurality of elongate grate pieces 602, each grate piece 602 having a body 603 with a first end 604 and a second end 605. Each grate piece 602 has the first end 604 angled with respect to the body 603 and the second end 605 angled with respect to the body 603. When the first end 604 of a grate piece 602*a* is welded to the first end of an adjacent grate piece 602*b*, and the second end 605 of the grate piece 602*a* is welded to the second end of the adjacent grate piece 602*b* so as to form the grate 601, a gap is formed between the respective bodies of the grate pieces 602 to permit the drainage of liquid between the grate pieces. By varying the angles at which the grate pieces 602 are welded together sections of grate with both horizontal and vertical curvature can be formed.

18 Claims, 6 Drawing Sheets

A
101
A
102
103

101
102
103

101
102
103

B
301
B
302

301
302

404
402
403
401

GRATES

FIELD OF THE INVENTION

The invention relates to improved grates for drainage and discharging overland flow of excess water and other liquids and relates particularly, though not exclusively, to trench grates.

BACKGROUND OF THE INVENTION

It has been found in practice that there are a number of problems associated with the manufacture, design, installation and use of prior art trench grates for picking up and discharging overland flow of water and other liquids.

Some of the problems with prior art grates include:

(a) During manufacturing, the confined space for welding short lateral bars between two longitudinal flat bars. This process is time-consuming, difficult to clean-up and unattractive. FIG. 1(*a*) is a plan view of a simple welded prior art grate 100 comprising two longitudinal flat bars 101, a plurality of lateral flat bars 102 joined to the longitudinal flat bars 101 by welds 103. The section view provided in FIG. 1(*c*) illustrates the confined space available for welding and cleaning-up.

(b) The curved design of some roadways, car parks, kerbing, pathways, etc. requires a curved grate to match both horizontal and vertical curvatures. Existing technology generally forces designers to use short lengths of straight grate to achieve these curvatures, which is not totally satisfactory as this causes noticeable changes of direction and catch points for debris collection. In FIG. 2(*a*) the gaps between horizontal grate sections are evident and in FIG. 2(*b*) the vertical change of grade is inconsistent with undulating road and path designs.

(c) A limitation of existing grates is that the lateral bars are generally at right angles to the longitudinal bars 301 and generally vertically oriented as shown in FIGS. 3(*a*) and (*b*). This restriction on the design of prior art trench grate installations limits the effectiveness of water entry to the channel below the grate and does not allow effective design to avoid debris pick-up locations.

(d) Contemporary concrete placing machinery used for channels and guttering is often computer-controlled to allow very attractive horizontal and vertical curves. This extends to drainage channels of the kind illustrated in FIG. 4. A short straight grate 402 is difficult to fit into horizontally and vertically curved channels, leaving vertical gaps 403 and horizontal gaps 404 between the grate 402 and the channel 401. This is in addition to the gaps and grade changes shown in FIG. 2.

Various attempts have been made to overcome the problem of welding in confined spaces noted in (a) above. U.S. Pat. No. 5,024,550 discloses a grate with two longitudinal angle bars with punched holes to reveal L-shaped tabbed ends of lateral flat bars. The space is still somewhat limited on the top end of the tab and the need for slats and tabs is expensive. There is no provision for vertical or horizontal curvature of the grate.

Some attempts have been made to eliminate welding in grates altogether, such as for example in U.S. Pat. No. 4,452,025 where the longitudinal bars have been locked to the lateral bars using rods inserted through the bars at 45° to both bars. This method does not really suit long narrow grates, and it also does not provide any means for horizontal or vertical curvature. Other weld-free grates are disclosed in U.S. Pat. Nos. 5,604,949 and 5,735,008 and these would be more suited to long narrow grates. However they also have no provision for horizontal or vertical curvature.

Some prior art trench grates are designed with a horizontal curvature as shown in FIG. 5. In this type of grate the longitudinal bars are curved and the lateral bars are welded radially from the centre of curvature of the longitudinal bars. However this type of prior art grate cannot easily provide for vertical curvature.

The present invention was developed with a view to providing an improved grate and method of manufacturing a grate that overcomes at least some of the above-noted problems with prior art grates.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided an improved grate for drainage of liquid from a surface, the grate comprising:

a plurality of elongate grate pieces, each grate piece having a body with a first end and a second end, each grate piece having at least the first end angled with respect to the body, wherein when the first end of a grate piece is welded to the first end of an adjacent grate piece, and the second end of the grate piece is welded to the second end of an adjacent grate piece so as to form the grate, a gap is formed between the respective bodies of the grate pieces to permit the drainage of liquid between the grate pieces.

Advantageously a first plurality of the grate pieces, each having the first end of different configuration from the second end, are welded together to form a section of the grate with horizontal curvature.

In one embodiment the first end and the second end of the body of the grate piece each take the form of a leg, the first leg being longer than the second leg.

Preferably a second plurality of the grate pieces, each having the extremities of the first and second ends cut-off at an inclined angle, are welded together to form a section of the grate with vertical curvature.

In another embodiment each grate piece is formed from a blank shape so that when the first and second ends are bent relative to the body, it forms a grate piece with an inclined body.

Typically at least some of the grate pieces are substantially U-shaped. At least some of the grate pieces may also be substantially L-shaped. Alternatively at least some of the grate pieces are substantially Z-shaped.

According to a second aspect of the present invention there is provided a method of manufacturing an improved grate for drainage of liquid from a surface, the method comprising the steps of:

providing a plurality of elongate grate pieces, each grate piece having a body with a first end and a second end, each grate piece having at least the first end angled with respect to the body; and, welding the first end of a grate piece to the first end of an adjacent grate piece, and the second end of the grate piece to the second end of the adjacent grate piece;

wherein as the grate pieces are welded together, a gap formed between the respective bodies of the grate pieces permits the drainage of liquid between the grate pieces.

The term "welding", "welded" or "weld" as employed throughout this specification refers to the joining of two work pieces by the application of sufficient heat to cause a melting of the work pieces in the vicinity of the weld that results in a fusing or coalescing of the material of the work pieces with or without a filler material. The material of the work pieces may be a metal or plastics material or other suitable material.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of preferred embodiments of the improved grates, given by way of example only, with reference to the accompanying drawings, in which:

FIG. 1(*b*) is an isometric or perspective view of the prior art grate shown in FIG. 1(*a*);

FIG. 1(*c*) is a section view through the line A-A of the prior art grate shown in FIG. 1(*a*);

FIG. 2(*b*) is a side elevation of a three prior art grates passing over a section of road with a vertical change of grade;

FIG. 3(*b*) is a section view through the line A-A of the prior art grate shown in FIG. 3(*a*);

FIG. 6(*b*) is a side elevation of the improved grate of FIG. 6(*a*);

FIG. 6(*c*) is an enlargement of part of the grate shown in FIG. 6(*a*);

FIG. 6(*d*) is an enlargement of part of the grate shown in FIG. 6(*b*);

FIG. 7(*b*) is a perspective view of a grate piece according to the present invention illustrating the various angles at which the parts of the grate piece can be bent or cut;

FIG. 7(*c*) is a plan view of a grate piece according to the present invention illustrating some other bend angles of the parts of the grate piece that can be varied;

FIG. 8(*b*) is plan view of a blank for a grate piece employed in the manufacture of the improved grate of FIG. 8(*a*);

FIG. 8(*c*) is a plan view of the improved grate of FIG. 8(*a*);

FIG. 9(*a*) is a plan view of a fourth embodiment of an improved grate according to the present invention;

FIG. 9(*b*) is an enlargement of part of the grate shown in FIG. 9(*a*);

FIG. 10(*a*) is a plan view of a variation of the improved grate shown in FIG. 9(*a*);

FIG. 10(*b*) is an enlargement of part of the grate shown in FIG. 10(*a*);

FIG. 14(*b*) is a plan view of an eighth embodiment of an improved grate according to the present invention;

FIG. 15(*b*) is a top perspective view of a ninth embodiment of an improved grate according to the present invention.

DETAILED DESCRIPTION OF PREFERRED EMBODIMENTS

Figures 1, 1A, 1B, 1C, 2, 2A, 2B, 3, 3A, 3B, 4, 5:
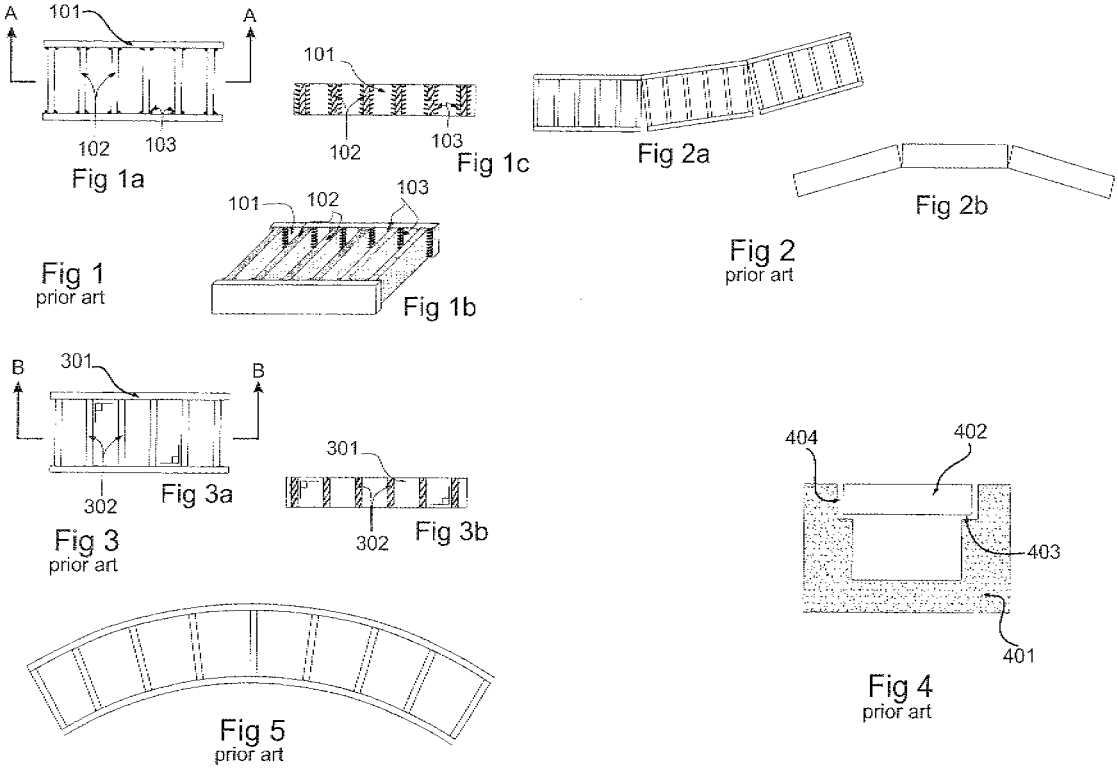
Fig 1 prior art
Fig 2 prior art
Fig 3 prior art
Fig 4 prior art
Fig 5 prior art
FIG. 1(*a*) is a plan view of a simple welded prior art trench grate.
FIG. 2(*a*) is a plan view of three prior art trench grates covering a curved channel.
FIG. 3(*a*) is a plan view of a simple welded prior art trench grate.
FIG. 4 is a section view through a prior art curved drainage channel covered by a prior art grate.
FIG. 5 is a plan view of a prior art curved trench grate.
Figure 6B:
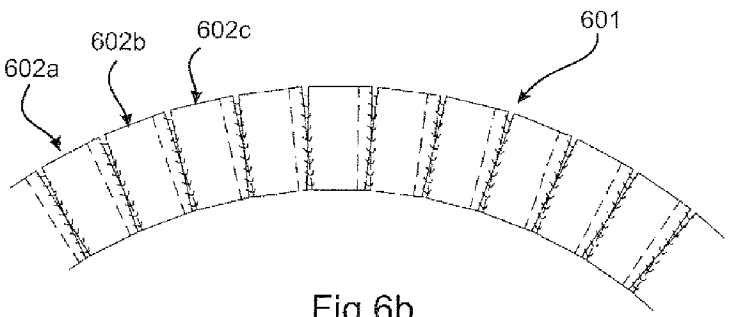
FIG. 6(*a*) is a plan view of a first embodiment of an improved grate according to the present invention.
Figure 6D:
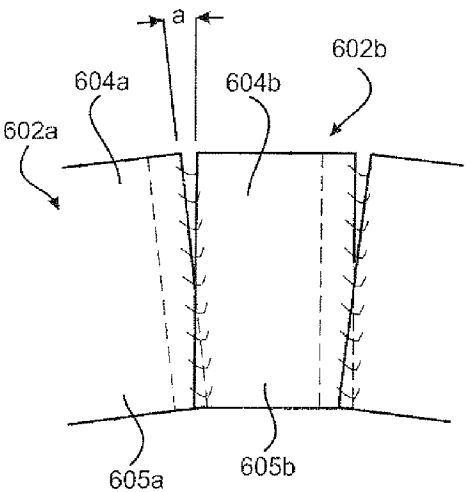
Figure 6A:
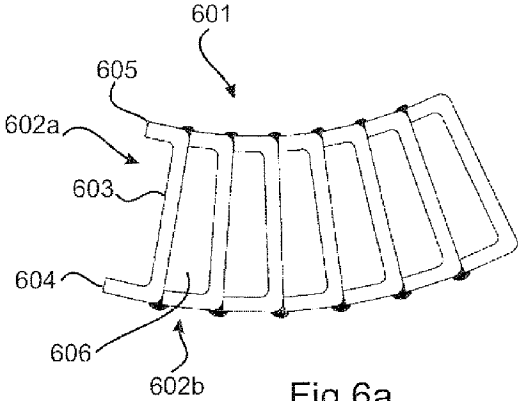
Figure 6C:
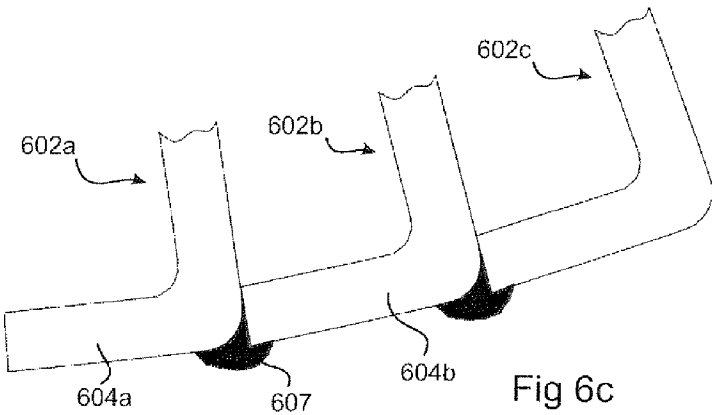

A preferred embodiment of an improved grate 601, as shown in FIG. 6 of the accompanying drawings, comprises a plurality of elongate grate pieces 602, each grate piece 602 having a body 603 with a first end 604 and a second end 605. Each grate piece 602 has at least the first end 604 angled with respect to the body 603. In this embodiment the second end 605 is also angled with respect to the body 603. Both the first end and the second end of each grate piece 602 are in the form of a leg which is bent at right angles to the body 603.

When the first end 604 of a grate piece 602*a* is welded to the first end of an adjacent grate piece 602*b*, and the second end 605 of the grate piece 602*a* is welded to the second end of the adjacent grate piece 602*b* so as to form the grate 601, a gap 606 is formed between the respective bodies of the grate pieces 602 to permit the drainage of liquid between the grate pieces. As can be seen more clearly in FIG. 6(*c*), a shoulder of the first end 604*a* of the grate piece 602*a* is welded to the extremity of the first end 604*b* of the adjacent grate piece 602*b* at weld 607. This shows the totally unconfined space for welding and clean-up of the join by using an "external" weld. It also shows that the weld will be hidden from view when it is set in a drainage channel.

In this embodiment a first plurality of the grate pieces 602, each having the first end 604 longer than the second end 605, are welded together to form a curved section of a grate 601. All of the grate pieces 602 of this embodiment are substantially identical in shape and size. However, if desired, additional grate pieces may be provided of a different shape and size to form an adjoining straight section of grate. Each grate piece 602 of this embodiment is formed from a U-shaped length of flat steel bar where the legs are of different lengths to provide the horizontal curvature. The angle of curvature may be varied by varying the relative lengths of the legs of the grate pieces 602. The grate 601 as shown in FIGS. 6(*a*) and (*b*) is formed with a horizontal curvature. However the same grate 601 may also be formed with a vertical curvature as shown in FIGS. 6(*b*) and (*d*). The vertical curvature may be formed by welding the first end 604*a* of the grate piece 602*a* to the first end 604*b* of an adjacent grate piece 602*b* offset at a vertical angle, (angle 'a' in FIG. 6(*d*)), and the second end 605*a* of the grate piece 602*a* is welded to the second end 605*b* of the adjacent grate piece 602*b* offset at the same or a similar angle.

Such a vertical curvature is readily achievable because the lateral sections (bodies 603) of the grate pieces 602 are relatively close together and very small vertical angular displacement between adjacent pieces will provide ample capacity to form the vertical curves with radii typically associated with roads, pathways, etc. FIG. 6(*d*) shows the small vertical angular displacement (offset angle 'a') necessary between adjacent grate pieces 602 before welding to achieve a smooth vertical curve.

Figure 8C:
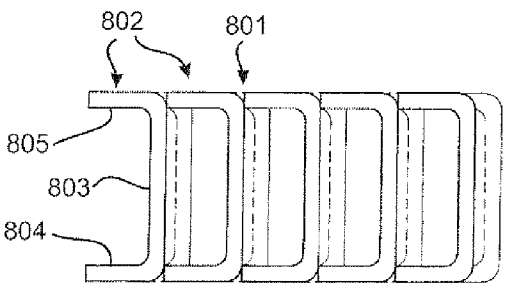
FIG. 8(*a*) is a side elevation of a third embodiment of an improved grate according to the present invention.
Figure 7B:
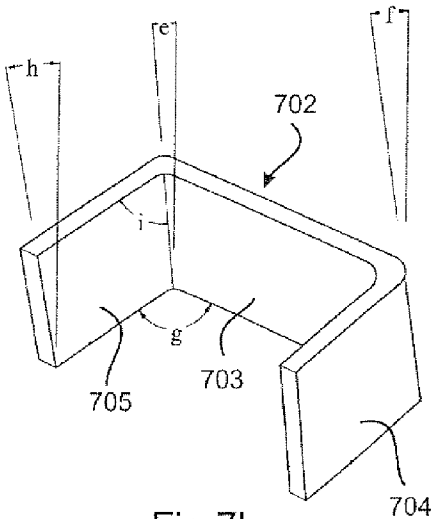
FIG. 7(*a*) is a side elevation of a second embodiment of an improved grate according to the present invention.
Figure 7C:
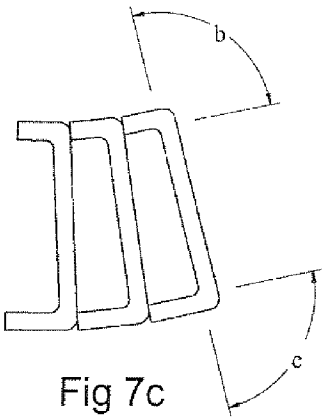
Figure 7A:
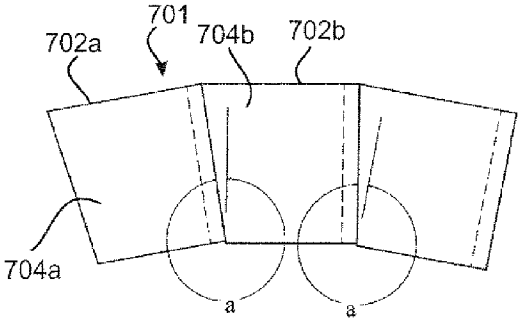
Figure 8A:
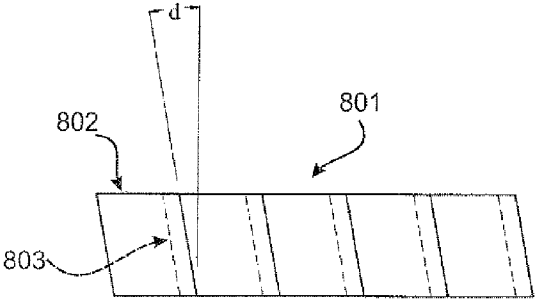
Figure 8B:
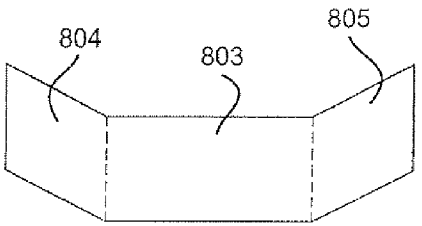

FIGS. 7 and 8 show how by varying any or all of the cut-off angles of the ends of the grate pieces, the angle of bend between the legs and body of the grate piece, and the length of the leg:

(a) The vertical angular displacement between adjacent grate pieces can be eliminated, whilst still producing a vertical curve.

(b) The horizontal and vertical angles of the body (central lateral section) relative to the legs can be varied to improve water entry conditions and reduce or eliminate debris collection points.

Super elevation can be provided in the grate, i.e. the level of the inside edge of the grate can be lower than the outside edge.

In the second embodiment of the grate 701 shown in FIG. 7(*a*) the ends 704 of the grate pieces 702 are cut-off at an angle 'a' to form a vertical curve when they are welded together. Angle 'a' in FIG. 7(*a*) corresponds to angle 'h' in FIG. 7(*b*). When angle 'h' is varied the angle of vertical curvature will also vary. In this manner the vertical curvature of the grate may be adjusted to perfectly match variations in the gradient of the roadway or footpath. Other angles that may be varied, when the legs 704 and 705 are bent relative to the body 703 of the grate piece 702, are shown as 'e', 'f', 'g' and 'i' in FIG. 7(*b*). These angles may be varied to achieve super elevation, horizontal and vertical curvature of the welded grate and horizontal and vertical inclination of the body (web or central lateral section) of the grate piece 702. In FIG. 7(*c*) the angles 'b' and 'c' between the legs and the normal to the legs may be varied to give an inclined horizontal angle of the body of each grate piece.

In the third embodiment of an improved grate 801 shown in FIGS. 8(*a*) and (*c*) each grate piece 802 is formed from a blank as shown in FIG. 8(*b*) prior to bending. When the ends 804 and 805 of the blank of FIG. 8(*b*) are bent along the fold lines to an angle of substantially 90° to the body or web 803, it forms a grate piece 802 with an inclined body or web 803. The angle of inclination 'd' to the vertical assists with improved water entry conditions.

An endless variety of designs of grates may be made by varying the size, shape and configuration of the grate pieces. FIG. 9 illustrates a fourth embodiment of the improved grate according to the present invention. In this embodiment two different types of grate pieces 902 and 903 are employed to form a semicircular grate 901. The first grate piece 902 is an L-shaped piece having a first end in the form of a leg that is bent at right angles to the body of the piece. The second end of the grate piece 902 is straight i.e. there is no bend. A plurality of the first grate pieces 902 are provided with their second (straight) ends welded together as shown in FIG. 9(*a*).

Interposed between the first grate pieces 902 are a series of the second grate pieces 903. Each second grate piece 903 also has a first end in the form of a leg that is bent at right angles to the body of the piece. However the body of grate piece 903 is shortened relative to the body of grate piece 902, and is bent at a point intermediate the first end and the second end. The second end of grate piece 903 is also straight and is welded to the second end of an adjacent first grate piece 902 at a point distant from the extremity of the second end. This arrangement of the two types of grate pieces 902 and 903 enables a much tighter angle of curvature to be achieved.

The embodiment of FIG. 10 is similar to that of FIG. 9, except that the second grate piece 1003 has its body bent in the opposite direction to that of the second grate piece 903. Hence the second end of the second grate piece 1003 in FIG. 10 is welded to the second end of the adjacent grate piece 1002 in front of it, rather than the one behind it, to form a grate 1001.

Figures 9A, 9B, 10A, 10B, 11, 12, 13:
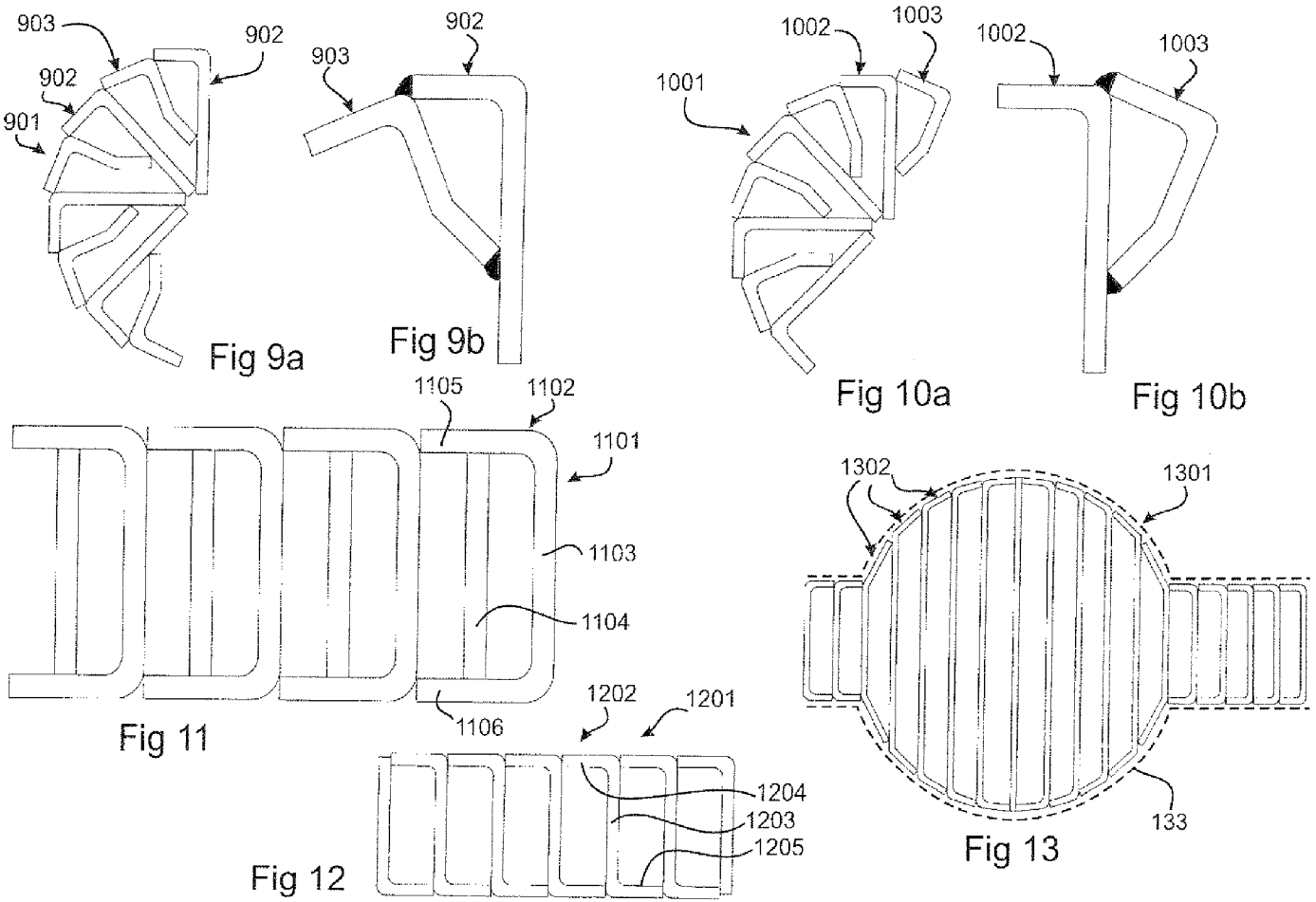
FIG. 11 is a plan view of a fifth embodiment of an improved grate according to the present invention.
FIG. 12 is a plan view of a sixth embodiment of an improved grate according to the present invention.
FIG. 13 is a plan view of a seventh embodiment of an improved grate according to the present invention.

FIG. 11 illustrates a fifth embodiment of a grate 1101 in which each grate piece 1102 is provided with a second lateral web 1104 in addition to its body 1103. The first and second ends of the grate piece 1102 are in the form of legs 1105 and 1106 extending at right angles to the body 1103. The legs 1105 and 1106 are somewhat longer than in the previous embodiments to accommodate the additional lateral web 1104 there between. The second lateral web 1104 is welded in place between the legs 1105 and 1106 substantially parallel to the body 1103 of the grate piece.

FIG. 12 illustrates a sixth embodiment of the improved grate 1201 in which each of the grate pieces 1202 are substantially Z-shaped rather than U-shaped. Instead of having the first and second ends 1204 and 1205 extending in the same direction, they extend in opposite directions, although still at substantially the same angle to the body 1203. Two L-shaped grate pieces are provided at the respective ends of the grate 1201.

Although each of the previous embodiments of the improved grate is substantially rectangular in shape, it will be appreciated that the grate may be made in any desired shape simply by changing the shape and configuration of the grate pieces. FIG. 13 illustrates a seventh embodiment of the invention in the form of an improved grate 1301 for a manhole 1303. By varying the length of the body of the grate pieces 1302, and the length and angle of the first and second ends of the grate pieces, a grate of circular configuration can be made. U-shaped grate pieces on each side form handles for the grate. The grate pieces 1302 may be positioned from the furthest end, or at the start, of a trench which leads into the manhole.

Figure 14A:
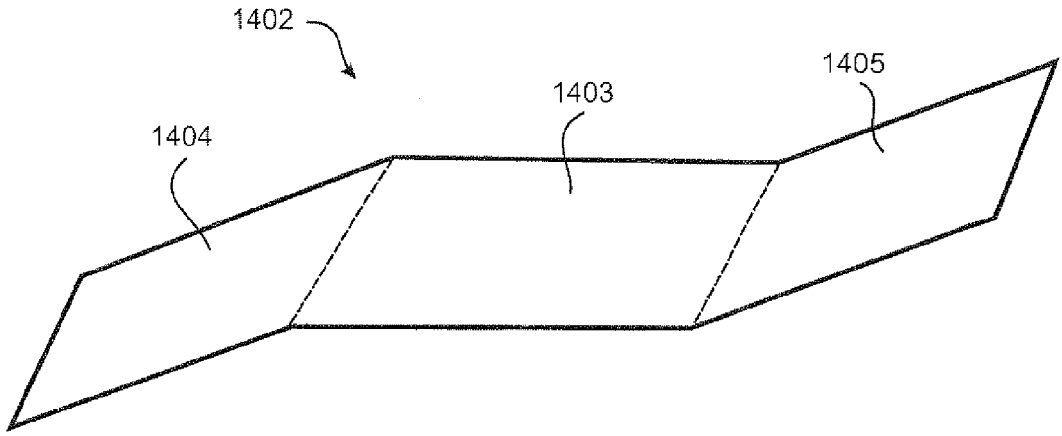
FIG. 14(*a*) is a plan view of a blank for a grate piece employed in the manufacture of the improved grate of FIG. 14(*b*)
Figure 14B:
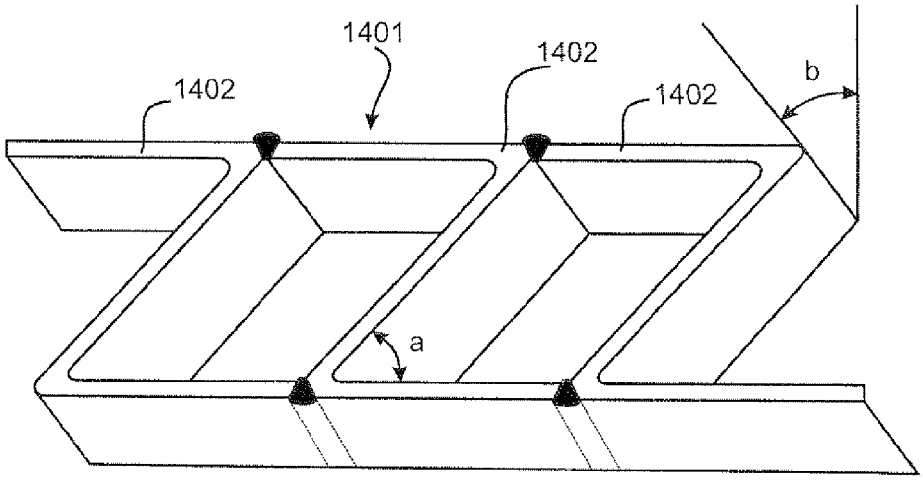

FIG. 14 illustrates an eighth embodiment of an improved grate 1401 according to the present invention. N or Z section grate pieces 1402 are welded together to form a trench grate 1401 as shown in FIG. 14(*b*). Each grate piece 1402 is formed from a blank as shown in FIG. 14(*a*) prior to bending. When the ends 1404 and 1405 of the blank of FIG. 14(*a*) are bent along the fold lines to an angle of substantially 45° to the body or web 1403, it forms a grate piece 1402 with an inclined body or web 1403. The grate pieces 1402 are inclined at a horizontal and vertical angle (angles a and b) to the water flow whilst still retaining the option of also having the welded multi-piece grate 1401 with a horizontal and vertical curvature.

Figures 15A, 15B:
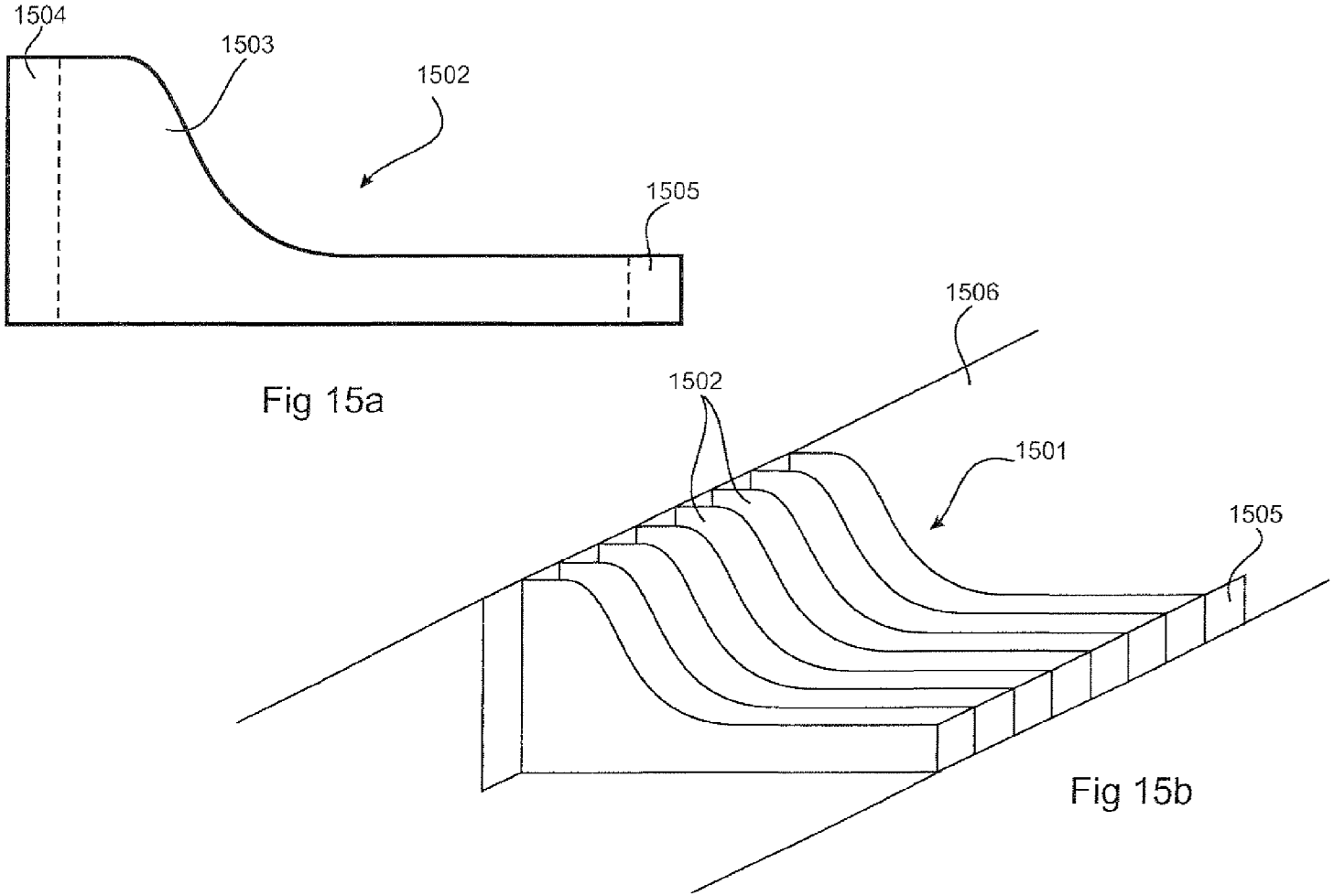
FIG. 15(*a*) is a plan view of a blank for a grate piece employed in the manufacture of the improved grate of FIG. 15(*b*)

FIG. 15 illustrates an improved grate 1501 manufactured from grate pieces 1502. Each grate piece 1502 is formed from a blank as shown in FIG. 15(*a*) prior to bending. The ends 1504 and 1505 of the blank of FIG. 15(*a*) are bent along the fold lines to an angle of substantially 90° to the body or web 1503, to form a grate piece 1502 with a body or web 1503 intended to fit the shape of a gutter or kerb 1506. When the first ends 1504 of the grate pieces 1502 are welded to the respective first ends of adjacent grate pieces, and the second ends 1505 of the grate pieces 1502 are welded to the respective second ends of the adjacent grate piece so as to form the grate 1501, gaps are formed between the respective bodies 1503 of the grate pieces 1502 to permit the drainage of liquid between the grate pieces. Due to the shape and configuration of the grate pieces 1502, the grate 1501 can be adapted to fit the required shape of a kerb. The grate 1501 can thus be inset into the gutter or kerb to divert the flow of the water, for example, away from a roadway.

With each of the described embodiments of the improved grate, the method of manufacturing the improved grate is substantially the same. The method comprises the steps of providing a plurality of elongate grate pieces, each grate piece having a body with a first end and a second end, each grate piece having at least the first end angled with respect to the body. The angles at which the respective ends of the grate piece are cut and/or bent with respect to the body is selected to achieve the desired curvature of the finished grate.

Then the first end of a grate piece is welded to the first end of an adjacent grate piece, and the second end of the grate piece is welded to the second end of the adjacent grate piece. The external location of the welds greatly simplifies this part of the process. This step is repeated for each of the grate pieces that go to make up the grate. When all the grate pieces are welded together, the gaps formed between the respective bodies of the grate pieces permit the drainage of liquid between the grate pieces.

Fabrication of the improved grates has led to the discovery of new uses for the grates. These include, but are not limited to, fabricating grates into letters and figures for signage in roadways and paved areas; grates for lights; pool surrounds; water parks and fountains; vertical inlet grates; cattle grates, aircraft runway drainage, rainwater collection, etc. The grates may be used in a vertical or inclined position as security grates or signage. The grates may also be used above or below natural ground level to retain soil for landscaping purposes or to form a retaining wall. The grates may serve any combination of the above purposes.

The improved grates may be fabricated from any suitable materials including, but not limited to, steel, aluminium, stainless steel, brass, zinc and all other bendable metals, as well as plastics, fibre glass and composite materials. Joining of the grate pieces together may be by welding, fusing, gluing or any other suitable means.

Now that preferred embodiments of the improved grate and method of making the same have been described in detail, it will be apparent that the embodiments provide a number of advantages over the prior art, including the following:

(i) The improved grates can be more easily fabricated as they do not require any internal welds, thus facilitating production on a large scale.

(ii) Due to the fact that the grates are formed using an "external" weld, the cleaning of the excess weld residue can be easily effected simply by brushing to clean the grates, in contrast to welding on the "inside" when cleaning of the excess "balls" of weld is difficult.

(iii) The improved grates can be readily formed to accommodate both horizontal and vertical curvature.

(iv) Due to the fact that the improved grate can be made in curved shapes, the grate can be readily placed over rises and uneven land forms to follow the profiles of the garden and landscape features.

(v) Versatility in the shape, configuration and arrangement of the grate pieces facilitates an enormous variety of grates in shape and size, including letters and figures used for signage in roadways, or in paved areas including to cover lighting.

(vi) Varying the horizontal and vertical angles of the lateral bars or bodies of the grate pieces provides better water entry conditions and helps to reduce or eliminate debris collection points.

(vii) Due to the flexible nature of the design of the grates, the grates can be used above or below natural ground level to retain soil for landscaping purposes, or to form a retaining wall.

It will be readily apparent to persons skilled in the relevant arts that various modifications and improvements may be made to the foregoing embodiments, in addition to those already described, without departing from the basic inventive concepts of the present invention. For example, it is not essential that the grate pieces be made from flat bar; they could be of elliptical or circular cross-section. Therefore, it will be appreciated that the scope of the invention is not limited to the specific embodiments described and is to be determined from the appended claims.

The claims defining the invention are as follows:

1. A grate for drainage of liquid from a surface, the grate comprising:

a plurality of elongate grate pieces, each grate piece having a solid body with a first end and a second end, each grate piece having at least the first end angled with respect to the body, wherein an edge of the first end of a grate piece is welded to and abuts an adjacent grate piece, and an edge of the second end of the grate piece is welded to and abuts another adjacent grate piece so as to form the grate, and wherein the edge of the first end and the edge of the second end are parallel to each other and to the solid body, wherein the first end and the second end of the body of the grate piece each take the form of a leg, the first leg being longer than the second leg, and a gap is formed between each of the respective bodies of the grate pieces to permit the drainage of liquid between the grate pieces.

2. The grate as defined in claim 1, wherein a first plurality of the grate pieces, each having the first end of different configuration from the second end, are welded together to form a section of the grate with horizontal curvature.

3. A grate for drainage of liquid from a surface, the grate comprising:

a plurality of elongate grate pieces, each grate piece having a solid body with a first end and a second end, each grate piece having at least the first end angled with respect to the body, wherein an edge of the first end of a grate piece is welded to and abuts an adjacent grate piece, and an edge of the second end of the grate piece is welded to and abuts another adjacent grate piece so as to form the grate, and wherein the edge of the first end and the edge of the second end are parallel to each other and to the solid body, wherein a second plurality of the grate pieces, each having the extremities of the first and second ends cut-off at an inclined angle, are welded together to form a section of the grate with vertical curvature, and a gap is formed between each of the respective bodies of the grate pieces to permit the drainage of liquid between the grate pieces.

4. The grate as defined in claim 1, wherein each grate piece is formed from a blank shape so that when the first and second ends are bent relative to the body, it forms a grate piece with an inclined body.

5. The grate as defined in claim 1, wherein at least some of the grate pieces are substantially U-shaped.

6. The grate as defined in claim 1, wherein at least some of the grate pieces are substantially L-shaped.

7. The grate as defined in claim 1, wherein at least some of the grate pieces are substantially Z-shaped.

8. A method of manufacturing an improved grate for drainage of liquid from a surface, the method comprising:

providing a plurality of elongate grate pieces, each grate piece having a body with a first end and a second end, each grate piece having at least the first end angled with respect to the body, wherein the length of the first end is longer than the length the second end; and, welding the first end of a grate piece to the first end of an adjacent grate piece, and the second end of the grate piece to the second end of the adjacent grate piece;

wherein as the grate pieces are welded together, a gap formed between the respective bodies of the grate pieces permits the drainage of liquid between the grate pieces.

9. A grate comprising:

an assembly of elongate grate pieces, wherein each grate piece includes a solid planar body with a first planar end and a second planar end and the first planar end is angled with respect to the solid planar body, and the first planer end has an edge parallel to the planar body and the second planar end has an edge parallel to the solid body;

a plurality of the elongated pieces each have an edge of the first planar end abutting and welded to an adjacent one of the grate pieces, and an edge of the second planar end abutting and welded to the second planar end of another adjacent one of the grate pieces, wherein the length of the first end is longer than the length of the second end, and a gap between each of the solid planar bodies of the adjacent grate pieces.

10. The grate as in claim 9 wherein the first ends of the grate pieces have different areas and the grate pieces are welded together to form a section of the grate with horizontal curvature.

11. The grate as defined in claim 9 wherein the first planar end has a distance between the solid body and the edge that is greater than a distance from the edge of the second planar end to the solid body.

12. The grate in claim 9 wherein the edges of a plurality of the grate pieces are inclined such that the grate pieces are welded together to form vertical curvature in the grate.

13. The grate as defined in claim 9 wherein a plurality of the grate pieces are substantially U-shaped.

14. The grate as defined in claim 9 wherein a plurality of the grate pieces are substantially L-shaped.

15. The grate as defined in claim 9 wherein a plurality of the grate pieces are substantially Z-shaped.

16. The grate as defined in claim 9 wherein the edge of the first end and the edge of the second end extend an entirety of the length of each of the respective ends.

17. A grate for drainage of liquid from a surface comprising:

a plurality of elongate grate pieces, each grate piece having a solid body with a first end and a second end, each grate piece having at least the first end angled with respect to the body, wherein the first end and the second end of the body of the grate piece each take the form of a leg, the first leg being longer than the second leg, and wherein an edge of the first end of a grate piece is welded to and abuts an adjacent grate piece, and an edge of the second end of the grate piece is welded to and abuts another adjacent grate piece so as to form the grate, and wherein the edge of the first end and the edge of the second end are parallel to each other and to the solid body, and a gap is formed between each of the respective bodies of the grate pieces to permit the drainage of liquid between the grate pieces.

18. A grate for drainage of liquid from a surface comprising:

a first plurality of elongate grate pieces, each grate piece having a solid body with a first end and a second end, each grate piece having at least the first end angled with respect to the body, wherein an edge of the first end of a grate piece is welded to and abuts an adjacent grate piece, and an edge of the second end of the grate piece is welded to and abuts another adjacent grate piece so as to form the grate, and wherein the edge of the first end and the edge of the second end are parallel to each other and to the solid body, and a gap is formed between each of the respective bodies of the grate pieces to permit the drainage of liquid between the grate pieces, wherein a second plurality of the grate pieces, each having the extremities of the first and second ends cut-off at an inclined angle, are welded together to form a section of the grate with vertical curvature.

* * * * *